US010126699B2

(12) United States Patent
Onishi

(10) Patent No.: US 10,126,699 B2
(45) Date of Patent: Nov. 13, 2018

(54) PHOTOSENSITIVE DRUM UNIT AND IMAGE FORMING APPARATUS

(71) Applicant: KYOCERA Document Solutions Inc., Osaka (JP)

(72) Inventor: Shota Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/619,184

(22) Filed: Jun. 9, 2017

(65) Prior Publication Data

US 2017/0364019 A1 Dec. 21, 2017

(30) Foreign Application Priority Data

Jun. 20, 2016 (JP) ..... 2016-121629

(51) Int. Cl.
*G03G 15/00* (2006.01)

(52) U.S. Cl.
CPC ..... *G03G 15/751* (2013.01)

(58) Field of Classification Search
CPC ..... G03G 15/751; G03G 15/75; G03G 15/80; G03G 15/757
See application file for complete search history.

(56) References Cited

U.S. PATENT DOCUMENTS 6,035,159 A * 3/2000 Azuma ..... G03G 15/757 399/111
6,301,458 B1 * 10/2001 Mori ..... G03G 15/751 399/117
9,146,496 B2 9/2015 Yonemoto
2007/0253729 A1 * 11/2007 Takagi ..... G03G 15/757 399/117
2008/0101824 A1 * 5/2008 Konishi ..... G03G 15/168 399/313
2008/0112724 A1 * 5/2008 Ohanyan ..... G03G 15/0894 399/109
2008/0112725 A1 * 5/2008 Ohanyan ..... G03G 15/0894 399/109
2010/0221037 A1 * 9/2010 Miyazaki ..... G03G 21/1623 399/112
2011/0286759 A1 * 11/2011 Ichihashi ..... G03G 15/167 399/90
2012/0003011 A1 * 1/2012 Lewis ..... G03G 15/0233 399/176

(Continued)

FOREIGN PATENT DOCUMENTS

JP 2001-356638 A 12/2001
JP 2014-109592 A 6/2014

*Primary Examiner* — Ruifeng Pu
(74) *Attorney, Agent, or Firm* — Studebaker & Brackett PC

(57) ABSTRACT

A photosensitive drum unit includes a photosensitive drum, a drum shaft, a resin frame, and a conducting member. The drum shaft is inserted through the photosensitive drum. The resin frame supports opposite ends of the drum shaft. The conducting member is a substantially coil-shaped spring member having a first end adjacent to the resin frame and a second end opposite to the first end. The conducting member is tapered from the first end toward the second end. The first end forms a first opening and the second end forms a second opening. A circle inscribed in the second opening has a diameter larger than an outer diameter of the drum shaft.

12 Claims, 8 Drawing Sheets

(56) References Cited

U.S. PATENT DOCUMENTS

| | | | | |
|---|---|---|---|---|
| 2012/0082482 | A1* | 4/2012 | Ishiguro | G03G 15/025 399/176 |
| 2014/0072342 | A1* | 3/2014 | Iijima | G03G 15/757 399/167 |
| 2014/0086614 | A1* | 3/2014 | Souda | G03G 15/0178 399/90 |
| 2014/0140728 | A1* | 5/2014 | Huang | G03G 15/757 399/167 |
| 2014/0153956 | A1 | 6/2014 | Yonemoto | |
| 2014/0341612 | A1* | 11/2014 | Ikeda | G03G 15/757 399/159 |
| 2015/0037060 | A1* | 2/2015 | Hamaya | G03G 15/80 399/90 |
| 2017/0248892 | A1* | 8/2017 | Yamamoto | G03G 15/80 |
| 2018/0004126 | A1* | 1/2018 | Kim | G03G 15/0896 |
| 2018/0074455 | A1* | 3/2018 | Takagi | G03G 15/1615 |

* cited by examiner

PHOTOSENSITIVE DRUM UNIT AND IMAGE FORMING APPARATUS

INCORPORATION BY REFERENCE

The present application claims priority under 35 U.S.C. § 119 to Japanese Patent Application No. 2016-121629, filed on Jun. 20, 2016. The contents of this application are incorporated herein by reference in their entirety.

BACKGROUND

The present disclosure relates to a photosensitive drum unit and an image forming apparatus.

In a photosensitive drum unit, a conducting member electrically connects a drum shaft and a drum tube. Specifically, the photosensitive drum unit includes the drum tube, the drum shaft, and the conducting member. The conducting member has a contact portion. When the drum shaft is inserted through the conducting member, the contact portion is enlarged radially outwardly and comes into contact with the inner circumferential surface of the drum tube.

SUMMARY

A photosensitive drum unit according to the present disclosure includes a drum tube, a flange member, a drum shaft, a frame, and a conducting member. The drum tube has a photosensitive layer thereon. The drum shaft is inserted through the drum tube. The frame supports opposite ends of the drum shaft. The conducting member electrically connects the drum shaft and the drum tube. The conducting member is a substantially coil-shaped spring member having a first end adjacent to the frame and a second end opposite to the first end. The conducting member is tapered from the first end toward the second end. The second end forms an opening. A circle inscribed in the opening has a diameter larger than an outer diameter of the drum shaft.

An image forming apparatus according to the present disclosure includes an image forming section that forms an image on a recording medium. The image forming section includes the photosensitive drum unit.

BRIEF DESCRIPTION OF THE DRAWINGS

FIG. 5A is a perspective view. FIG. 5B is an end view.

DETAILED DESCRIPTION

Figure 1:
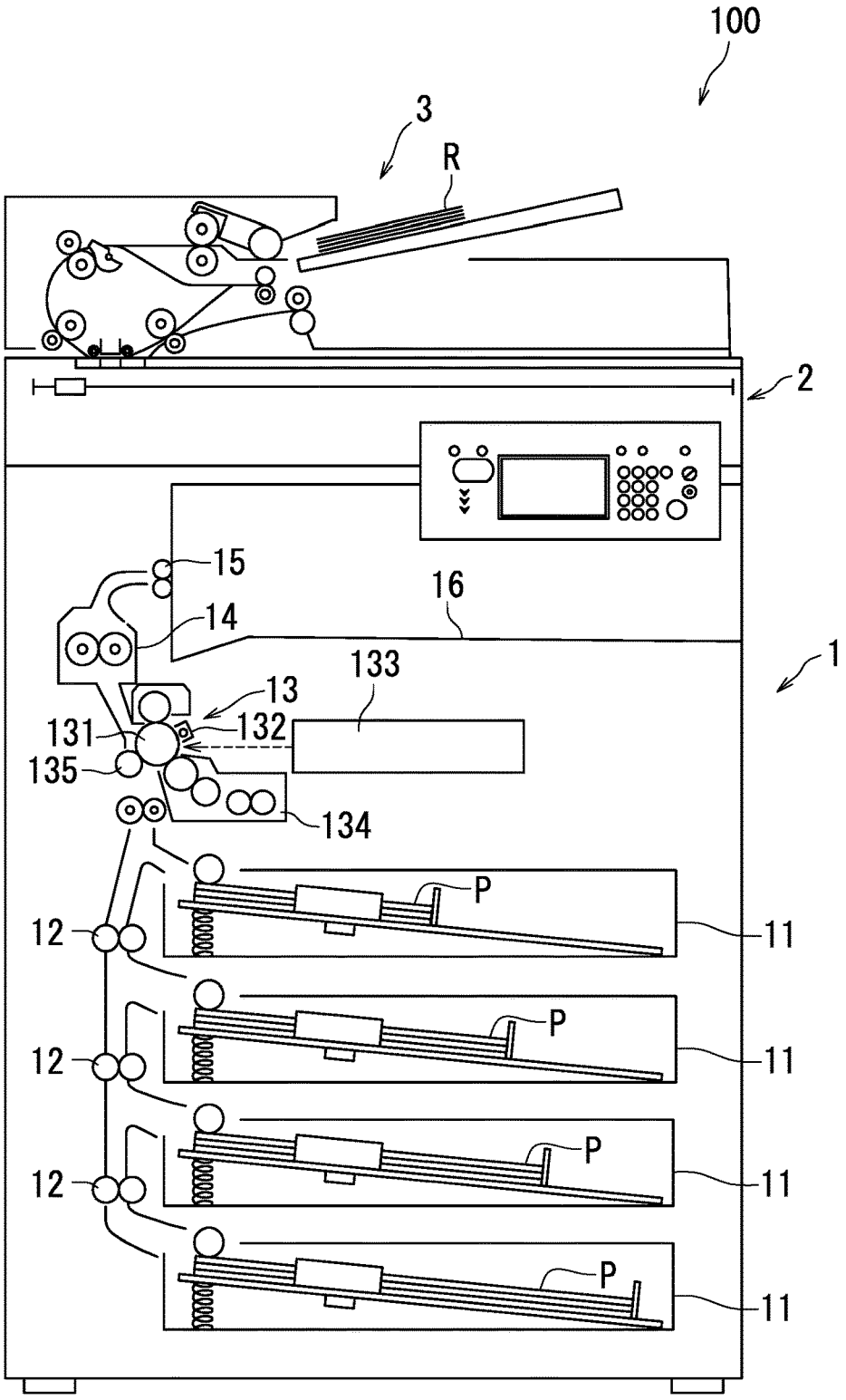
FIG. 1 is a diagram illustrating a configuration of an image forming apparatus according to an embodiment of the present disclosure.

The following describes embodiments of the present disclosure with reference to the drawings (FIGS. 1 to 8B). Elements that are the same or equivalent are indicated by the same reference signs in the drawings and explanation thereof will not be repeated.

First, an image forming apparatus 100 according to an embodiment of the present disclosure will be described with reference to FIG. 1. FIG. 1 is a diagram illustrating a configuration of the image forming apparatus 100. As illustrated in FIG. 1, the image forming apparatus 100 is a multifunction peripheral. The image forming apparatus 100 includes an image forming unit 1, an image reading unit 2, and a document conveyance unit 3.

The image forming unit 1 forms an image on paper P (a recording medium). The image reading unit 2 reads an image formed on a document R and generates image data corresponding to the read image. The document conveyance unit 3 feeds the document R to the image reading unit 2.

The image forming unit 1 includes feeding cassettes 11, conveyance roller pairs 12, an image forming section 13, a fixing section 14, an ejection roller pair 15, and an exit tray 16. Paper P fed from one of the feeding cassettes 11 is conveyed to the image forming section 13 by the conveyance roller pair(s) 12.

The image forming section 13 forms an image on the paper P. The image forming section 13 includes a photosensitive drum 131, a charger 132, a light exposure section 133, a development section 134, and a transfer roller 135. The photosensitive drum 131 is a rotary body having the shape of a hollow cylinder and a circumferential surface on which an electrostatic latent image is to be formed. The charger 132 charges the photosensitive drum 131 to a specific potential. The light exposure section 133 irradiates the circumferential surface of the photosensitive drum 131 with laser light based on image data. As a result, an electrostatic latent image corresponding to the image data is formed on the circumferential surface of the photosensitive drum 131. The image data is for example image data generated by the image reading unit 2 reading the document R or image data received from an external computer via a communication network not illustrated.

The development section 134 develops the electrostatic latent image formed on the circumferential surface of the photosensitive drum 131 by supplying toner to the electrostatic latent image to form a toner image on the circumferential surface of the photosensitive drum 131. The transfer roller 135 transfers the toner image from the photosensitive drum 131 to the paper P.

The paper P with the image formed thereon is conveyed to the fixing section 14. The fixing section 14 fixes the image on the paper P by applying heat and pressure thereto. The paper P with the image fixed thereon is ejected to the exit tray 16 by the ejection roller pair 15.

Figure 2:
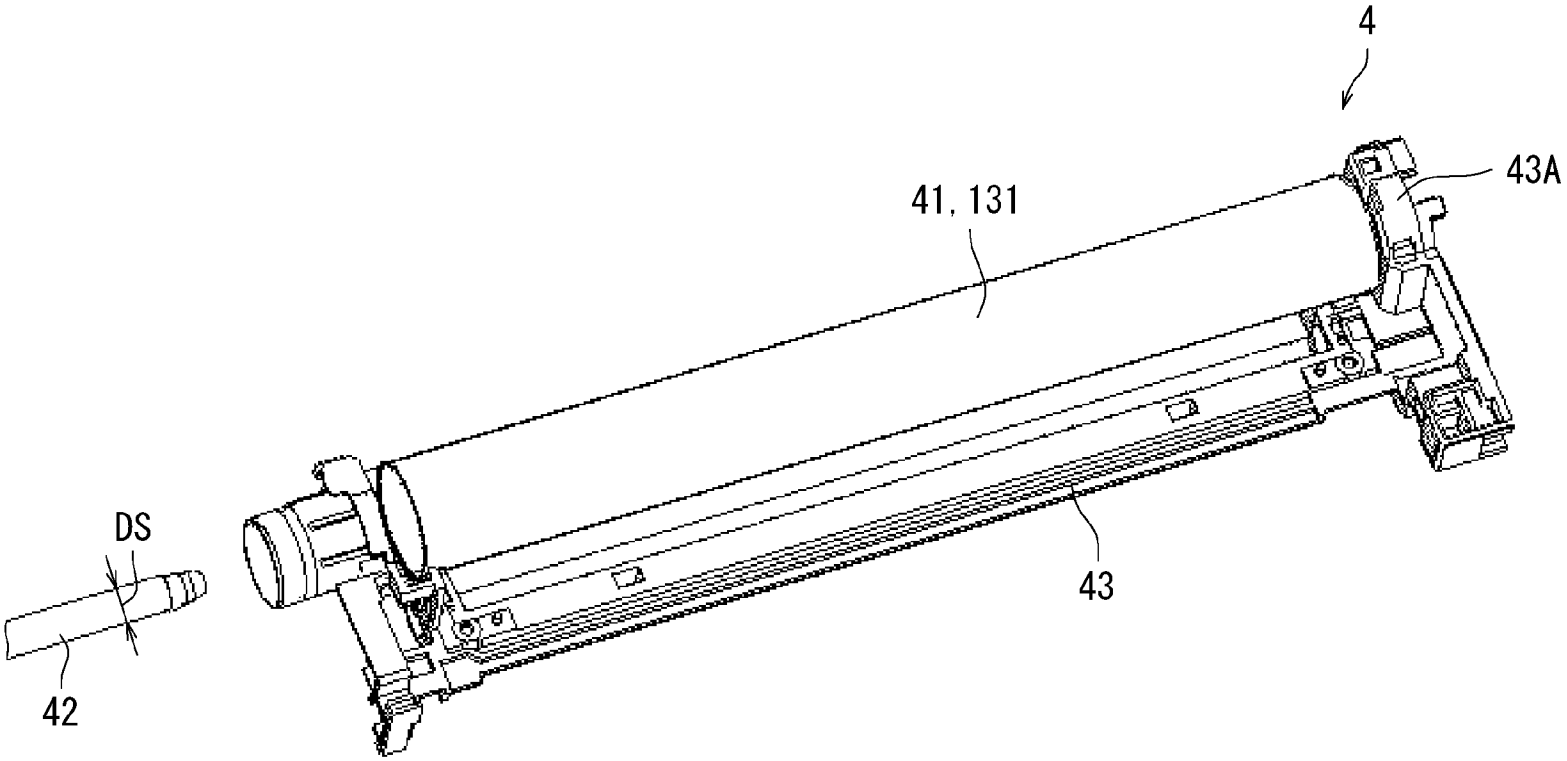
FIG. 2 is a diagram illustrating a configuration of a photosensitive drum unit according to an embodiment of the present disclosure.

Next, a photosensitive drum unit 4 according to an embodiment of the present disclosure will be described with reference to FIGS. 1 and 2. FIG. 2 is a diagram illustrating a configuration of the photosensitive drum unit 4. The image forming section 13 includes the photosensitive drum unit 4. As illustrated in FIG. 2, the photosensitive drum unit 4 includes a drum tube 41, a drum shaft 42, and a resin frame 43.

The drum tube 41 has the shape of a hollow cylinder and a circumferential surface with a photosensitive layer formed thereon. Opposite ends of the drum tube 41 are open. The drum tube 41 corresponds to the photosensitive drum 131.

Figure 8A:
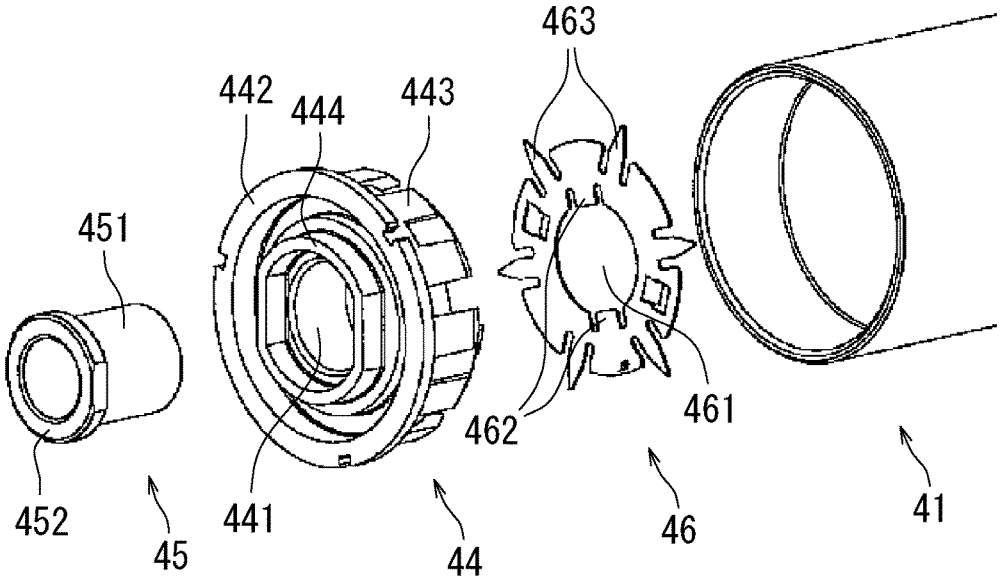
FIG. 8A is a perspective view illustrating a configuration of a photosensitive drum.
Figure 8B:
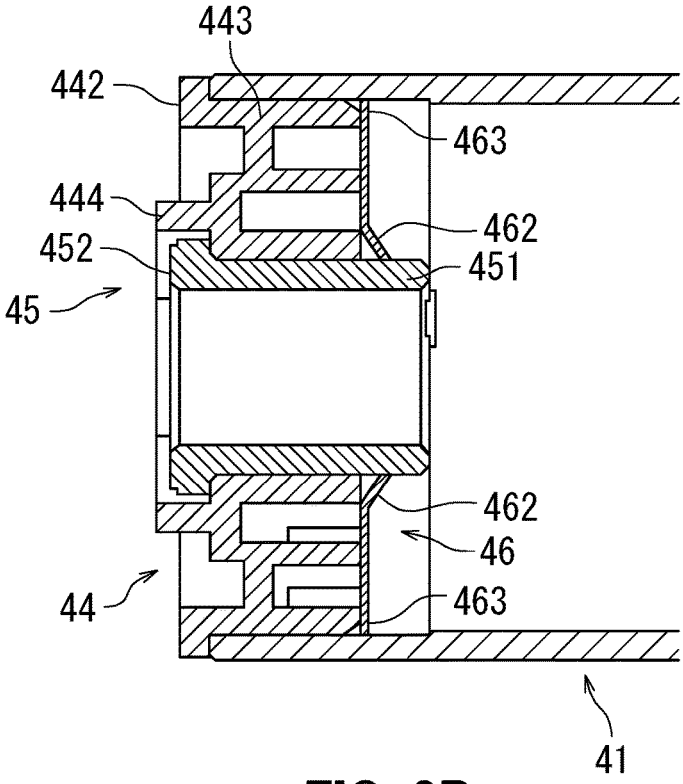
FIG. 8B is a cross-sectional view illustrating the configuration of the photosensitive drum.

A configuration of the photosensitive drum 131 will be described with reference to FIGS. 8A and 8B. FIG. 8A is a perspective view illustrating the configuration of the photosensitive drum 131. FIG. 8B is a cross-sectional view illustrating the configuration of the photosensitive drum 131. A flange member 44 is attached to each of the opposite ends of the drum tube 41 as illustrated in FIGS. 8A and 8B. A bearing 45 and a grounding plate 46 are attached to the flange member 44.

The flange member 44 has a through hole 441, an annular protrusion 442, a body 443, and an accommodation section 444. The annular protrusion 442 covers an end surface of the drum tube 41. The body 443 is press fitted in the drum tube 41. The through hole 441 is formed at the center of the flange member 44 so as to extend through the body 443 in an axial direction thereof. The accommodation section 444 is an elliptical space surrounded by a protrusion formed around the circumference of the through hole 441 at an end thereof at which the annular protrusion 442 is provided.

The bearing 45 is formed from a sintered material impregnated with lubricant. The bearing 45 has a hollow cylindrical portion 451 and an elliptical portion 452. The elliptical portion 452 is formed at an end of the hollow cylindrical portion 451 and has an elliptical outline. In a state where the hollow cylindrical portion 451 is fitted in the through hole 441 and the elliptical portion 452 is accommodated in the accommodation section 444, the bearing 45 rotates integrally with the flange member 44.

The grounding plate 46 is formed into a substantially disk-like shape from a thin metal plate having electrical conductivity. The grounding plate 46 has an opening 461, contact pieces 462, and claw portions 463. The opening 461 is formed at the center of the grounding plate 46 so that the hollow cylindrical portion 451 of the bearing 45 is inserted through the opening 461. The contact pieces 462 are formed at respective two opposite positions so as to protrude toward the opening 461. The claw portions 463 are formed at six positions on the perimeter of the grounding plate 46 so as to extend radially outwardly.

In a state where the bearing 45 is attached to the flange member 44, the contact pieces 462 of the grounding plate 46 are in strong contact with the outer circumference of the hollow cylindrical portion 451 of the bearing 45 protruding from an end of the through hole 441. Thus, the grounding plate 46 is fixed and electrically connected to the bearing 45. When the flange member 44 to which the bearing 45 and the grounding plate 46 are attached is press fitted in an end of the drum tube 41, tips of the claw portions 463 of the grounding plate 46 bite into the inner surface of the drum tube 41. Thus, the grounding plate 46 is electrically connected to the drum tube 41. As a result, the drum tube 41 and the bearing 45 are electrically connected via the grounding plate 46.

The drum shaft 42 is inserted through the bearing 45 of the photosensitive drum 131 and supports the photosensitive drum 131 rotatably. As illustrated in FIG. 2, the drum shaft 42 substantially has the shape of a solid cylinder having a first outer diameter DS.

The resin frame 43 supports the drum shaft 42. Specifically, the resin frame 43 supports opposite ends of the drum shaft 42 inserted therein. The resin frame 43 is an example of a "frame". The resin frame 43 has a support portion 43A at a longitudinal end thereof. The support portion 43A supports one of the opposite ends of the drum shaft 42.

Figure 3:
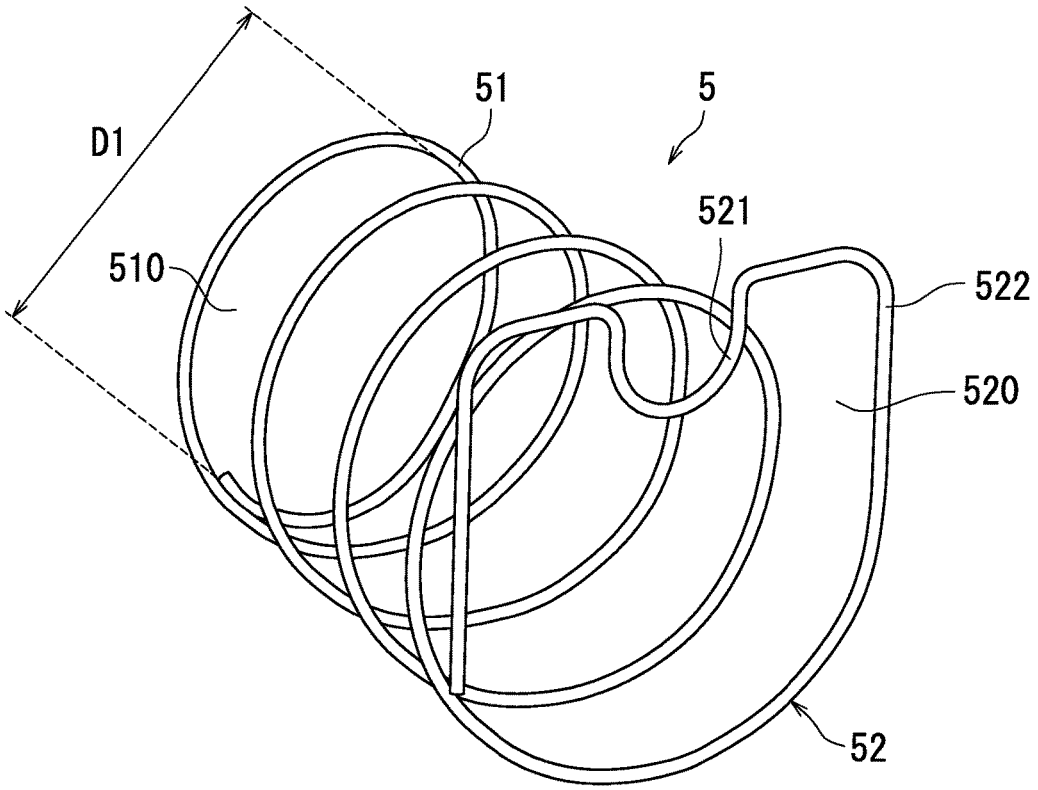
FIG. 3 is a perspective view illustrating a conducting member.

Next, a configuration of the conducting member 5 will be described with reference to FIGS. 2 and 3. FIG. 3 is a perspective view illustrating the conducting member 5. As illustrated in FIG. 3, the conducting member 5 is a substantially coil-shaped spring member having a first end 52 and a second end 51.

The first end 52 of the conducting member 5 is adjacent to the resin frame 43 (support portion 43A). The first end 52 has a protrusion 521 and a contact portion 522. The protrusion 521 protrudes toward a central axis of the conducting member 5. The protrusion 521 substantially has a U-shape. The first end 52 forms a first opening 520.

The contact portion 522 comes into contact with an end surface of the support portion 43A of the resin frame 43 facing the photosensitive drum 131. The contact portion 522 substantially has a rectangular shape. Specifically, the contact portion 522 substantially has the shape of a non-square rectangle. The contact portion 522 and the protrusion 521 are formed integrally. Specifically, the contact portion 522 is formed by bending a wire member forming the conducting member 5. Also, the protrusion 521 is formed by bending the wire member forming the conducting member 5 approximately at the middle of a side of the contact portion 522.

The second end 51 of the conducting member 5 is opposite to the first end 52. The conducting member 5 is tapered from the first end 52 toward the second end 51. Specifically, the conducting member 5 substantially has the shape of a truncated cone having a base located at the first end 52. The second end 51 forms a second opening 510.

A circle inscribed in the second opening 510 has a diameter D1 larger than the first outer diameter DS of the drum shaft 42 illustrated in FIG. 2. The second opening 510 corresponds to an "opening".

The drum shaft 42 is inserted through the conducting member 5 from the second opening 510 at the second end 51 toward the first opening 520 at the first end 52, and an end of the drum shaft 42 is fixed to the resin frame 43 (support portion 43A).

As described above with reference to FIGS. 2 and 3, in the embodiment of the present disclosure, the circle inscribed in the second opening 510 of the conducting member 5 has the diameter D1 larger than the first outer diameter DS of the drum shaft 42. Therefore, when the drum shaft 42 is inserted through the conducting member 5 from the second opening 510 toward the first opening 520, a possibility that the drum shaft 42 gets caught at the second end 51 of the conducting member 5 is reduced. Also, the conducting member 5 is tapered from the first end 52 toward the second end 51. Therefore, when the drum shaft 42 is inserted through the conducting member 5 from the second opening 510 toward the first opening 520, a possibility that the drum shaft 42 gets caught between the second end 51 and the first end 52 of the conducting member 5 is reduced. As a result, the conducting member 5 is prevented from being interposed between the drum shaft 42 and the resin frame 43 (support portion 43A). Therefore, the photosensitive drum unit 4 is capable of being assembled easily.

Figure 4:
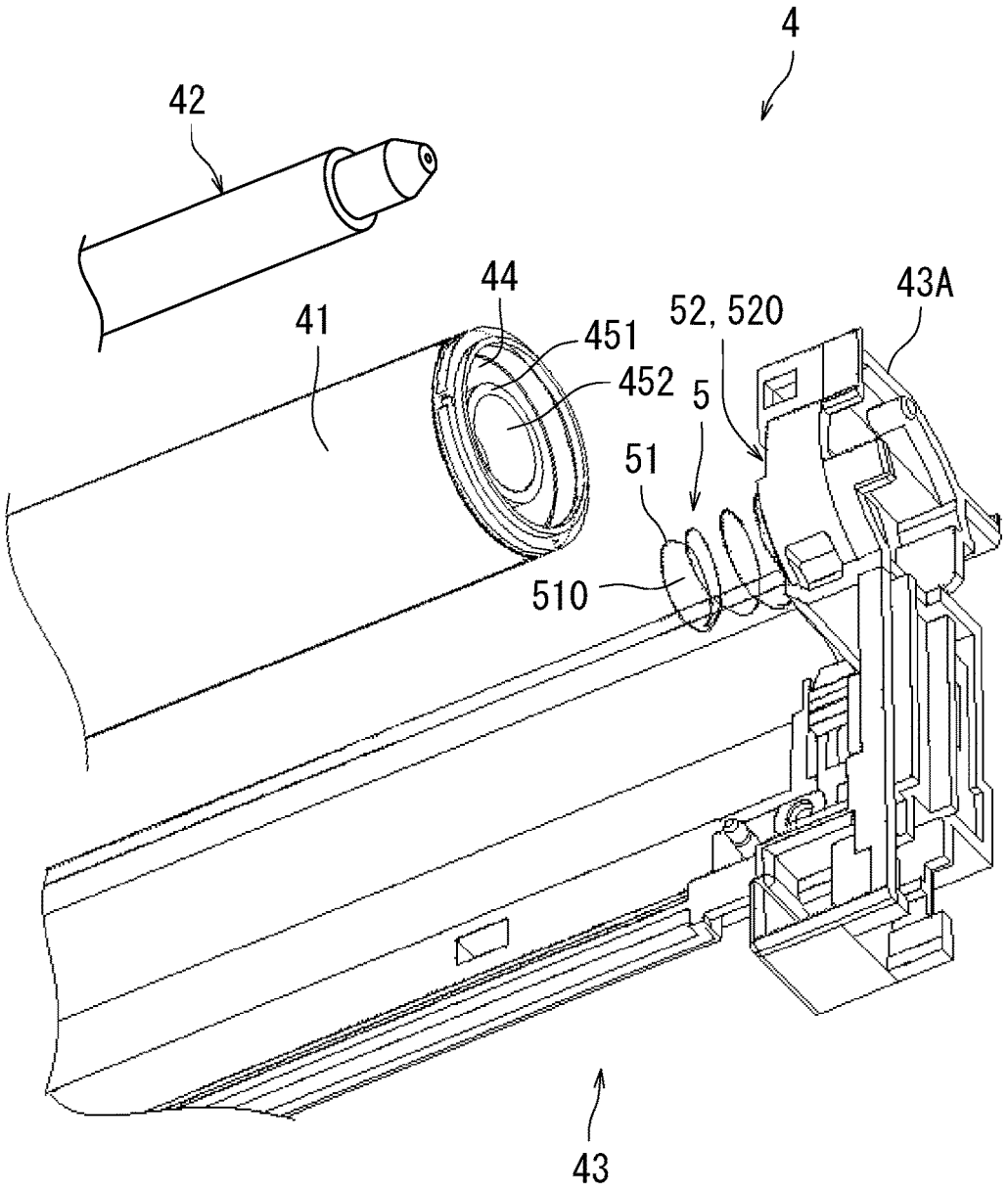
FIG. 4 is a diagram illustrating the conducting member disposed in the photosensitive drum unit.

Next, a procedure for assembling the photosensitive drum unit 4 will be described with reference to FIGS. 2 to 4. FIG. 4 is a diagram illustrating the conducting member 5. As illustrated in FIG. 4, the conducting member 5 is included in the photosensitive drum unit 4. The second end 51 of the conducting member 5 is disposed away from the resin frame 43 (support portion 43A). Specifically, the first end 52 of the conducting member 5 is disposed in contact with the support portion 43A and the second end 51 of the conducting member 5 is disposed away from the support portion 43A. The second end 51 of the conducting member 5 comes into contact with the elliptical portion 452 of the bearing 45 of the photosensitive drum 131.

The following describes the procedure for assembling the photosensitive drum unit 4.

First, the first end 52 of the conducting member 5 is brought into contact with the support portion 43A.

Next, the elliptical portion 452 of the bearing 45 attached to the flange member 44 is brought into contact with the second end 51 of the conducting member 5, and the photosensitive drum 131 is pressed toward the support portion 43A. As a result, the conducting member 5 is compressed and fixed between the elliptical portion 452 of the bearing 45 and the support portion 43A. Then, the drum shaft 42 is inserted through the bearing 45.

Further, the drum shaft 42 is inserted through the conducting member 5 from the second opening 510 toward the first opening 520.

Finally, the drum shaft 42 is attached to the support portion 43A.

Figure 5A:
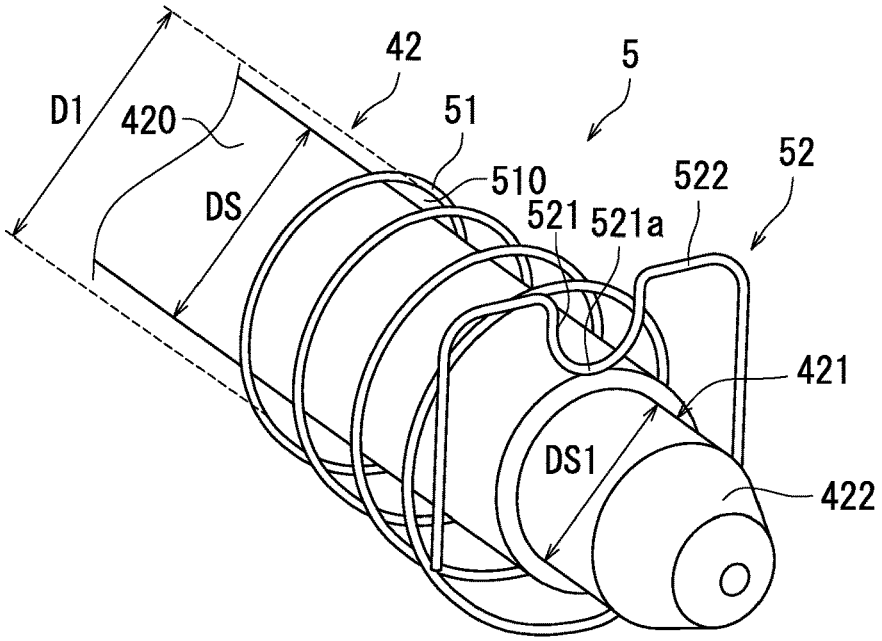
FIGS. 5A and 5B are diagrams each illustrating the conducting member through which a drum shaft is inserted.
Figure 5B:
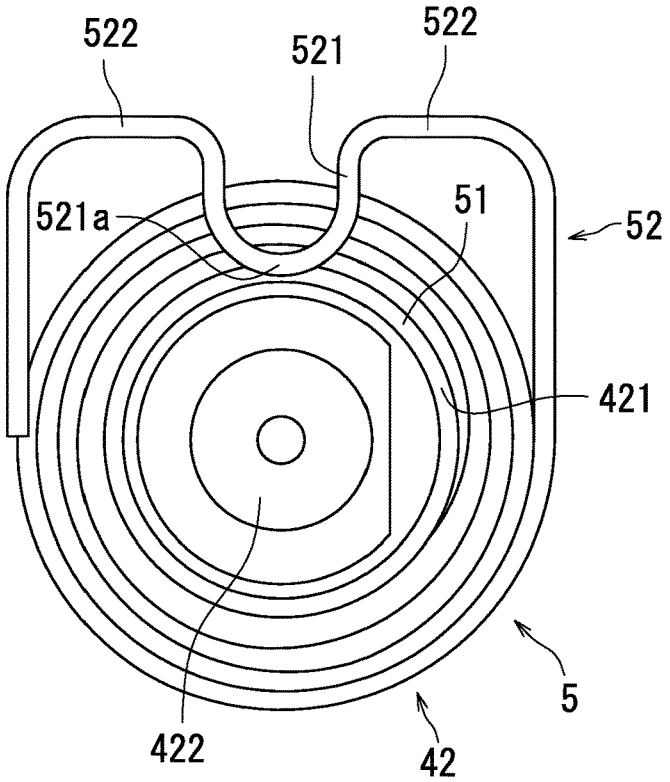

Next, the conducting member 5 and the drum shaft 42 will be described with reference to FIGS. 2 to 5B. FIGS. 5A and 5B are diagrams each illustrating the conducting member 5 through which the drum shaft 42 is inserted. FIG. 5A is a perspective view and FIG. 5B is an end view. As illustrated in FIG. 5A, the drum shaft 42 has a body 420, a step portion 421, and a tip end portion 422.

The body 420 is located at the middle in an axial direction of the drum shaft 42 and has the shape of a solid cylinder. The body 420 is inserted through the bearing 45 attached to the flange member 44 and supports the drum tube 41 via the flange member 44. The body 420 has the first outer diameter DS.

The step portion 421 is located between the body 420 and the tip end portion 422. The step portion 421 decreases the outer diameter of the drum shaft 42 stepwise from the body 420 toward the tip end portion 422. Specifically, the step portion 421 decreases the outer diameter of the drum shaft 42 stepwise from the first outer diameter DS to a second outer diameter DS1.

The tip end portion 422 includes the end of the drum shaft 42 and a diameter of the tip end portion 422 decreases toward the end of the drum shaft 42. Specifically, the diameter of the tip end portion 422 is tapered toward the end of the drum shaft 42.

A tip 521*a* of the protrusion 521 of the first end 52 of the conducting member 5 comes into contact with the step portion 421 of the drum shaft 42. Specifically, the tip 521*a* of the protrusion 521 is located, in terms of a radial direction of the drum shaft 42, outside of a circle having the second outer diameter DS1 and inside of a circle having the first outer diameter DS. As a result, the conducting member 5 is electrically connected to the drum shaft 42.

As described above with reference to FIGS. 2 to 5B, the first end 52 of the conducting member 5 is electrically connected to the drum shaft 42 and the second end 51 of the conducting member 5 is electrically connected to the bearing 45 attached to the flange member 44. Therefore, the conducting member 5 is capable of electrically connecting the bearing 45 and the drum shaft 42. Further, the bearing 45 is electrically connected to the drum tube 41. As a result, the conducting member 5 is capable of electrically connecting the drum tube 41 and the drum shaft 42.

Although the bearing 45 and the drum shaft 42 are electrically connected directly to each other, while the photosensitive drum 131 is rotated, an oil film may be formed between the bearing 45 and the drum shaft 42 due to the lubricant with which the bearing 45 is impregnated. When the oil film is formed between the bearing 45 and the drum shaft 42, electrical connection between the bearing 45 and the drum shaft 42 becomes unstable. However, the conducting member 5 is capable of electrically connecting the bearing 45 and the drum shaft 42 stably.

Further, the conducting member 5 is a substantially coil-shaped spring member substantially having the shape of a truncated cone. Therefore, the conducting member 5 is capable of being compressed between the flange member 44 and the support portion 43A of the resin frame 43. Therefore, a distance between the flange member 44 and the support portion 43A of the resin frame 43 can be reduced. As a result, the photosensitive drum unit 4 can be downsized.

Further, the first end 52 of the conducting member 5 has the protrusion 521 protruding toward the central axis of the conducting member 5 and electrically connected to the drum shaft 42. Therefore, electrical connection between the first end 52 and the drum shaft 42 is ensured.

Further, the protrusion 521 substantially has a U-shape. Therefore, when the tip 521*a* of the protrusion 521 comes into contact with the drum shaft 42, the surface of the drum shaft 42 is prevented from being damaged by the tip 521*a* of the protrusion 521.

Figure 6:
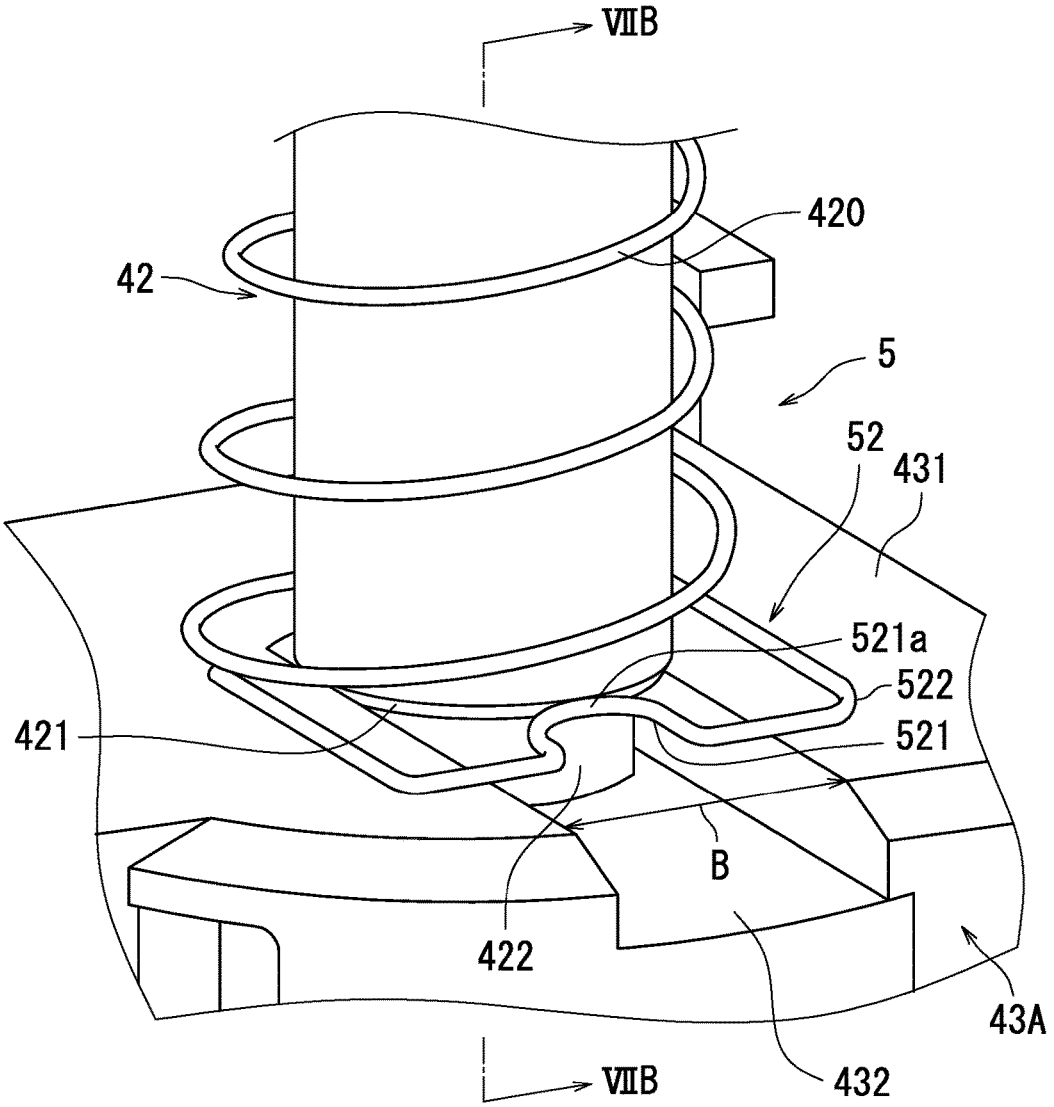
FIG. 6 is a diagram illustrating the conducting member attached to a resin frame.

Next, the support portion 43A of the resin frame 43 and the conducting member 5 will be described with reference to FIGS. 2 to 7B. FIG. 6 is a diagram illustrating the conducting member 5 attached to the support portion 43A of the resin frame 43. As illustrated in FIG. 6, the support portion 43A has an end surface 431 and a recess 432.

The end surface 431 is an end surface of the support portion 43A facing the drum tube 41. The end surface 431 is substantially flat. The contact portion 522 of the first end 52 of the conducting member 5 comes into contact with the end surface 431. Further, the drum shaft 42 is inserted through the conducting member 5. The step portion 421 of the drum shaft 42 comes into contact with the end surface 431.

The recess 432 is formed such that the tip 521*a* of the protrusion 521 is fitted in the recess 432 when the drum shaft 42 is attached to the support portion 43A of the resin frame 43. Specifically, the recess 432 is formed in a part of the end surface 431 so as to include a position into which the drum shaft 42 is inserted and a position opposed to the protrusion 521. The recess 432 substantially has the shape of a rectangular parallelepiped having a bottom and three sides adjacent to one another. The recess 432 has a width B smaller than the first outer diameter DS and larger than the second outer diameter DS1. The width B is a dimension of the recess 432 in a direction substantially parallel with a plane including the end surface 431 and substantially orthogonal to a direction connecting the protrusion 521 and the central axis of the drum shaft 42.

Figure 7A:
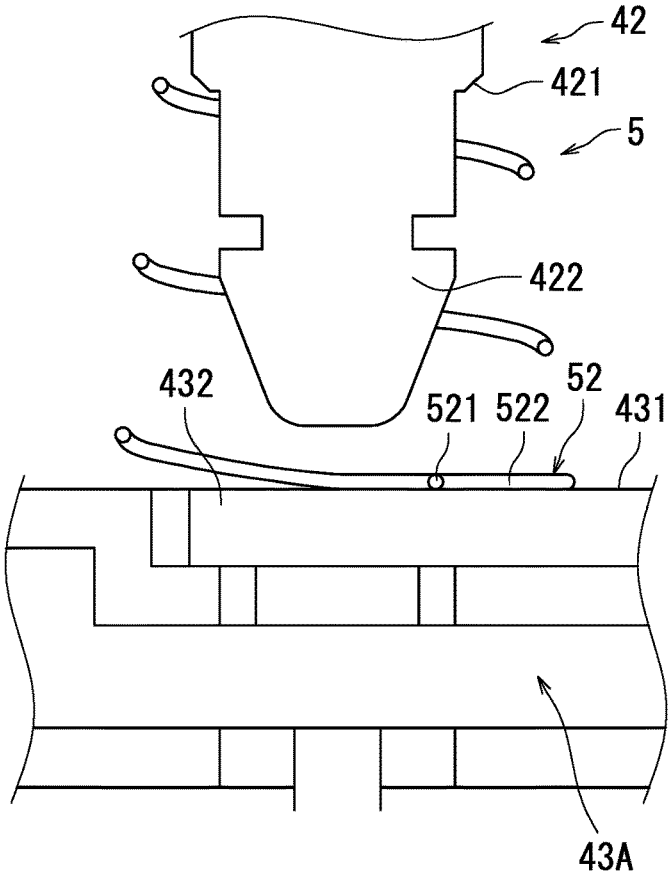
FIG. 7A is a cross-sectional view illustrating the conducting member before the drum shaft is attached to the resin frame.
Figure 7B:
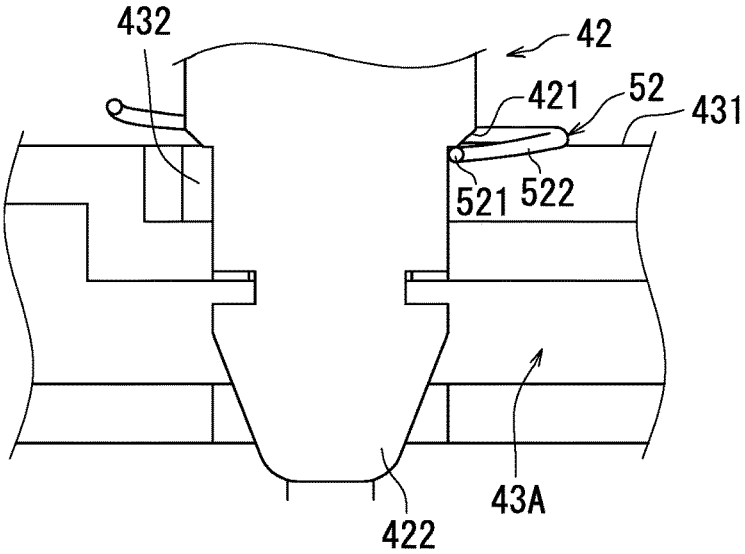
FIG. 7B is a cross-sectional view illustrating the conducting member when the drum shaft is attached to the resin frame.

Next, the conducting member 5 before and after the drum shaft 42 is attached to the support portion 43A of the resin frame 43 will be described with reference to FIGS. 7A and 7B. FIG. 7A is a cross-sectional view illustrating the conducting member 5 before the drum shaft 42 is attached to the resin frame 43. FIG. 7B is a cross-sectional view illustrating the conducting member 5 after the drum shaft 42 is attached to the resin frame 43.

As illustrated in FIG. 7A, the first end 52 of the conducting member 5 is in contact with the end surface 431 of the support portion 43A before the drum shaft 42 is attached to the support portion 43A. The protrusion 521 is located on a plane including the end surface 431.

As illustrated in FIG. 7B, the contact portion 522 of the first end 52 of the conducting member 5 is pressed against the end surface 431 after the drum shaft 42 is attached to the support portion 43A. The step portion 421 of the drum shaft 42 is in contact with the end surface 431. The protrusion 521 is pressed into the recess 432 by the step portion 421 of the drum shaft 42. The conducting member 5 is compressed between the elliptical portion 452 of the bearing 45 and the end surface 431 of the support portion 43A.

As described above with reference to FIGS. 2 to 7B, the tip 521*a* of the protrusion 521 of the first end 52 of the conducting member 5 is located closer to the central axis of the drum shaft 42 than the outer circumferential surface of the body 420 of the drum shaft 42. Further, the drum shaft 42 has the step portion 421 that decreases the outer diameter of the drum shaft 42 stepwise toward the tip end portion 422. When the drum shaft 42 is attached to the support portion 43A of the resin frame 43, the tip 521*a* of the protrusion 521 is pressed and warped by the step portion 421 toward the support portion 43A. In the above configuration in which the tip 521*a* of the protrusion 521 is pressed by the step portion 421, electrical connection between the tip 521*a* of the protrusion 521 and the step portion 421 is ensured. Therefore, electrical connection between the conducting member 5 and the drum shaft 42 is ensured.

The first end 52 of the conducting member 5 further has the contact portion 522 formed integrally with the protrusion 521. The contact portion 522 is in contact with the end surface 431 of the support portion 43A facing the drum tube 41. Thus, the contact portion 522 is fixed to the support portion 43A. On the other hand, the second end 51 of the conducting member 5 is in contact with the elliptical portion 452 of the bearing 45. Therefore, the conducting member 5 is fixed between the bearing 45 and the support portion 43A. As a result, the conducting member 5 is prevented from rotating in accompaniment with rotation of the drum tube 41. Also, generation of rubbing noise due to rotation of the conducting member 5 in accompaniment with rotation of the drum tube 41 is prevented.

Further, the support portion 43A of the resin frame 43 has the recess 432 in the end surface 431 facing the drum tube 41. When the drum shaft 42 is attached to the support portion 43A, the tip 521*a* of the protrusion 521 is fitted in the recess 432. Thus, the protrusion 521 is fixed at the position of the recess 432. On the other hand, the flange member 44 is attached to the end surface of the drum tube 41 and the second end 51 of the conducting member 5 is in contact with the bearing 45 fixed to the flange member 44. Therefore, when the drum tube 41 is rotating, force that causes rotation of the conducting member 5 is applied to the conducting member 5 via the bearing 45. However, the conducting member 5 is surely prevented from rotating in accompaniment with rotation of the drum tube 41 since the protrusion 521 is fixed at the position of the recess 432. Therefore, generation of rubbing noise due to rotation of the conducting member 5 in accompaniment with rotation of the drum tube 41 is surely prevented.

Further, the contact portion 522 substantially has a rectangular shape. Since the substantially rectangular contact portion 522 is in contact with the end surface 431 of the support portion 43A, the conducting member 5 is unlikely to tilt from its upright position relative to the end surface 431 of the support portion 43A. Therefore, the conducting member 5 is surely fixed to the support portion 43A. As a result, the conducting member 5 is surely prevented from rotating in accompaniment with rotation of the drum tube 41.

Through the above, the embodiments of the present disclosure have been described with reference to the drawings. However, it should be noted that the present disclosure is not limited to the above embodiments and is practicable in various manners within the scope not departing from the gist of the present disclosure (for example, as described below in sections (1) to (6)). The drawings schematically illustrate elements of configuration in order to facilitate understanding, and properties of elements of configuration illustrated in the drawings, such as thicknesses, lengths, and numbers thereof, may differ from actual properties thereof in order to facilitate preparation of the drawings. Furthermore, properties of the elements of configuration described in the above embodiments, such as shapes and dimensions, are merely examples and are not intended as specific limitations. Various alterations may be made so long as there is no substantial deviation from the configuration of the present disclosure.

(1) As described above with reference to FIG. 3, the conducting member 5 substantially has the shape of a truncated cone having a base located at the first end 52. However, the present disclosure is not limited to this configuration. It is only required that the conducting member 5 is tapered from the first end 52 toward the second end 51. For example, the conducting member 5 may be tapered stepwise from the first end 52 toward the second end 51. Also, the conducting member 5 may substantially has the shape of a truncated pyramid (for example, truncated four-sided pyramid) having a base located at the first end 52.

(2) As described above with reference to FIG. 3, the first end 52 of the conducting member 5 has the protrusion 521 electrically connected to the drum shaft 42. However, the present disclosure is not limited to this configuration. It is only required that the first end 52 of the conducting member 5 is configured to be electrically connected to the drum shaft 42. For example, an end portion of the wire member forming the first end 52 of the conducting member 5 may be bent toward the central axis of the conducting member 5 so as to be electrically connected to the drum shaft 42.

(3) As described above with reference to FIG. 3, the protrusion 521 substantially has a U-shape. However, the present disclosure is not limited to this configuration. It is only required that the protrusion 521 protrudes toward the central axis of the conducting member 5. For example, the protrusion 521 may substantially have a V-shape.

(4) As described above with reference to FIG. 4, the second end 51 of the conducting member 5 is electrically connected to the bearing 45 fixed to the flange member 44. However, the present disclosure is not limited to this configuration. In a configuration, the flange member 44 may be formed from an electrically conductive material and an end surface of the flange member 44 and the second end 51 of the conducting member 5 may be electrically connected to each other through contact therebetween. It is only required that the second end 51 of the conducting member 5 is configured to be electrically connected to the drum tube 41. For example, at least a part of the second end 51 of the conducting member 5 may be in contact with the inner circumferential surface of the drum tube 41. Specifically, an end portion of the wire member forming the second end 51 of the conducting member 5 may be bent away from the central axis of the conducting member 5 so as to be in contact with the inner circumferential surface of the drum tube 41.

(5) As described above with reference to FIGS. 5A and 5B, the resin frame 43 (support portion 43A) has the recess 432 in the end surface 431 facing the drum tube 41. However, the present disclosure is not limited to this configuration. It is only required that the end surface 431 of the resin frame 43 (support portion 43A) facing the drum tube 41 has a space in which the tip 521*a* of the protrusion 521 is fitted. For example, the resin frame 43 (support portion 43A) may have no end surface 431 at a position opposed to the tip 521*a* of the protrusion 521. Specifically, the end surface 431 of the resin frame 43 (support portion 43A) may be formed only at a position for supporting the step portion 421 of the drum shaft 42.

(6) As described above with reference to FIG. 6, the contact portion 522 of the conducting member 5 substantially has a rectangular shape. However, the present disclosure is not limited to this configuration. It is only required that the contact portion 522 of the conducting member 5 is configured to be in contact with the end surface 431 of the resin frame 43 (support portion 43A). The contact portion 522 of the conducting member 5 may substantially have the shape of a plate (or a strip) having a surface parallel to the end surface 431.

What is claimed is:

1. A photosensitive drum unit comprising:
a drum tube having a photosensitive layer thereon;
a drum shaft inserted through the drum tube;
a frame supporting opposite ends of the drum shaft; and
a conducting member electrically connecting the drum shaft and the drum tube, wherein
the conducting member is a substantially coil-shaped spring member having a first end adjacent to the frame and a second end opposite to the first end,
the conducting member is tapered from the first end toward the second end,
the second end forms an opening,
a circle inscribed in the opening has a diameter larger than an outer diameter of the drum shaft,
the first end of the conducting member has a protrusion protruding toward a central axis of the conducting member, and
the protrusion is electrically connected to the drum shaft.

2. The photosensitive drum unit according to claim 1, further comprising
a flange member attached to one of opposite ends of the drum tube and electrically connected to the drum tube, wherein
the first end of the conducting member is electrically connected to the drum shaft, and
the second end of the conducting member is electrically connected to the flange member.

3. The photosensitive drum unit according to claim 1, wherein
the protrusion substantially has a U-shape.

4. The photosensitive drum unit according to claim 1, wherein
the protrusion of the first end of the conducting member has a tip located closer to the central axis of the drum shaft than an outer circumferential surface of a body of the drum shaft,
the drum shaft has a step portion that decreases an outer diameter of the drum shaft stepwise toward an end thereof, and
the tip of the protrusion is pressed and warped by the step portion toward the frame.

5. The photosensitive drum unit according to claim 4, wherein
the frame has a recess in an end surface of the frame facing the drum tube, and
the tip of the protrusion of the conducting member is fitted in the recess.

6. The photosensitive drum unit according to claim 1, wherein
the first end of the conducting member further has a contact portion integral with the protrusion, and
the contact portion of the conducting member is in contact with an end surface of the frame facing the drum tube.

7. The photosensitive drum unit according to claim 6, wherein
the contact portion of the conducting member substantially has a rectangular shape.

8. A photosensitive drum unit comprising:
a drum tube having a photosensitive layer thereon;
a drum shaft inserted through the drum tube;
a frame supporting opposite ends of the drum shaft; and
a conducting member electrically connecting the drum shaft and the drum tube, wherein
the conducting member is a substantially coil-shaped spring member having a first end adjacent to the frame and a second end opposite to the first end,
the conducting member is tapered from the first end toward the second end,
the second end forms an opening,
a circle inscribed in the opening has a diameter larger than an outer diameter of the drum shaft,
the photosensitive drum unit further comprises a flange member attached to one of opposite ends of the drum tube and electrically connected to the drum tube,
the first end of the conducting member is electrically connected to the drum shaft,
the second end of the conducting member is electrically connected to the flange member,
a bearing and a grounding plate are attached to the flange member,
the bearing is fixed to the flange member in a manner to rotate integrally with the flange member,
the grounding plate electrically connects the drum tube and the bearing, and
the bearing has an end surface in contact with the second end of the conducting member.

9. The photosensitive drum unit according to claim 8, wherein
the second end of the conducting member substantially has an annular shape, and
the end surface of the bearing has an outer diameter larger than that of the second end of the conducting member.

10. The photosensitive drum unit according to claim 4, wherein
the drum shaft has a tip end portion located closer to the end of the drum shaft than the step portion and having an outer diameter smoothly decreasing toward the end of the drum shaft.

11. The photosensitive drum unit according to claim 1, wherein
the conducting member is tapered smoothly from the first end toward the second end.

12. An image forming apparatus comprising
an image forming section that forms an image on a recording medium, wherein
the image forming section includes the photosensitive drum unit according to claim 1.

* * * * *